United States Patent [19]

Gönner

[11] Patent Number: 4,825,917

[45] Date of Patent: May 2, 1989

[54] APPARATUS FOR PRODUCING THIN BOARDS

[76] Inventor: Siegmar Gönner, Albersbacher Str. 48, D-7602 Oberkirch, Fed. Rep. of Germany

[21] Appl. No.: 150,939

[22] Filed: Feb. 1, 1988

[30] Foreign Application Priority Data

Jan. 31, 1987 [DE] Fed. Rep. of Germany ..... 3702909

[51] Int. Cl.[4] ..... B27L 9/00

[52] U.S. Cl. ..... 144/3 P; 83/404.4; 83/425.3; 144/120; 144/184; 198/624; 198/836

[58] Field of Search ..... 144/3 P, 184, 187, 120; 198/624, 836; 83/404.4, 425.3, 370

[56] References Cited

U.S. PATENT DOCUMENTS

| | | | |
|---|---|---|---|
| 1,503,784 | 8/1924 | Dumont | 144/3 P |
| 3,783,917 | 1/1974 | Mochizuki | 144/120 |
| 3,998,252 | 12/1976 | Senba | 144/184 |
| 4,589,456 | 5/1986 | Traben | 144/3 P |

FOREIGN PATENT DOCUMENTS

| | | | |
|---|---|---|---|
| 159282 | 11/1961 | U.S.S.R. | 144/3 P |

*Primary Examiner*—W. Donald Bray

[57] ABSTRACT

An apparatus for producing thin boards by chipless cutting of the boards from a log or a squared timber on one or both opposing sides of the timber where the apparatus includes a support means for the article being cut and a cutter station which is arranged in at least one side of the support and including a cutter blade engageable with the squared timber. A pressure applying means is located on the other side of the squared timber opposite from the cutter station to urge the squared timber against the cutter station at an adjustable pressure. A feed system is arranged to move the squared timber toward the cutter blade, and includes at least one pair of feed rollers which are floatingly supported in a direction transverse to the support. The rollers are arranged to adapt to the position of the squared timber developed by the contact pressure at the contact station while maintaining symmetrical clamping forces.

10 Claims, 3 Drawing Sheets

APPARATUS FOR PRODUCING THIN BOARDS

BACKGROUND OF THE INVENTION

1. Field of the Invention

The present invention relates to an apparatus for producing thin boards by chipless cutting of the boards from a log or a squared timber on one or both opposite sides of the squared timber.

2. Description of the Prior Art

It is necessary in chipless separation processes to achieve adequate surface quality in the cut boards. This is rendered very difficult because of the tendency of the wood to split and tear. An apparatus has been proposed which has a cutter blade on one side and on the opposite side has a contact pressure band with pressure rollers. In the apparatus, the contact pressure band with the pressure rollers is used both for applying the contact pressure forces and also the forces required to feed the wood. Since, however, the pressure needed to achieve a good quality cut is not necessarily the same as the pressure which is needed to apply the required feed forces toward the cutter blade or the set of cutter blades, contact pressure forces cannot be choosen on the basis of the requirements for the cutting quality alone.

Opposing cutter blade arrangements are known from DE-OS 33 43 294 where feed elements are provided separate from the contact pressure system, since no feed can be achieved by the contact pressure of the opposing cutter blade set. The feed rollers which have been used to the present, which are essentially arranged on swinging arms in order to accommodate logs of varying thicknesses, did not offer the possibility of applying great clamping forces for the substantial feed forces required for chipless-cutting separation without the pressure conditions of the wood between the cutter blade sets being changed with respect to forces at the same time, i.e., symmetrically high clamping forces are not possible regardless of the particular position of the log or the squared timber at any one time.

SUMMARY OF THE INVENTION

The present invention makes it possible to control the contact clamping forces required for feeding the timber, regardless of the pressure against the cutter blade. The present invention also provides a feed clamping device which does not interact with the position of the log or squared timber by its contact pressure.

In keeping with the present invention, the feed devices that move the squared timber consist of at least one pair of feed rollers that grasp the squared timber on opposite sides. Each pair of feed rollers is arranged so as to be floatingly supported and is movable, regardless of the clamping forces exerted by it against the squared timber, in a direction which is transerse to the feed direction so that it can adapt to the position of the squared timber that is determined by the application pressure on the cutter system while maintaining symmetrical clamping forces.

In one embodiment of the invention, each pair of feed rollers, including the force generating system which applies a clamping force, is positioned on a slide that can be moved freely transversely to the feed direction.

In a preferred embodiment, the force generating devices that apply the clamping force are in the form of operating cylinders which are acted upon by pressurized fluid. The cylinders are fixed on the support frame. The operating cylinders of a pair of rollers are connected to each other by a cross-connecting conduit. A desired number of pairs of feed rollers can be arranged ahead of and behind the cutter station. In an apparatus with a cutter station and an opposing contact pressure system, the latter may consist of a series of contact pressure rollers that can be pressed against the squared timber individually, and the contact pressure of these rollers can be transmitted to the squared timber through a rotating resilient belt. This resilient belt can also pass around feed rollers that are located on the same side as the contact pressure system.

The contact pressure force of the contact pressure system or of the second cutter system, where one is employed, is expediently controlled independently of the clamping force of the feed rollers.

It is desirable that the pairs of feed rollers ahead of and behind the cutter station are movable and adjustable independently of each other in order that the front pairs of feed rollers can be opened to accept a new squared timber when the preceding squared timber is still being held by the rear pair of feed rollers.

Since the contact pressure required to achieve a high quality cut does not necessarily coincide with the pressure required to apply the great feed forces against the cutter blades, these elements have been separated. However, the substantial forces on the feed rollers must not disturb, with respect to the forces, the position of the wood determined by the contact pressure of the wood on the cutter blade. For this reason, the pairs of rollers which are opposite the contact pressure rollers, or a second cutter system which functions similarly to the pairs of rollers have been arranged in a floating arrangement.

BRIEF DESCRIPTION OF THE DRAWINGS

The invention will be described in greater detail below based upon the embodiments shown in the drawings. In the drawings.

DESCRIPTION OF THE PREFERRED EMBODIMENTS

Figure 1:
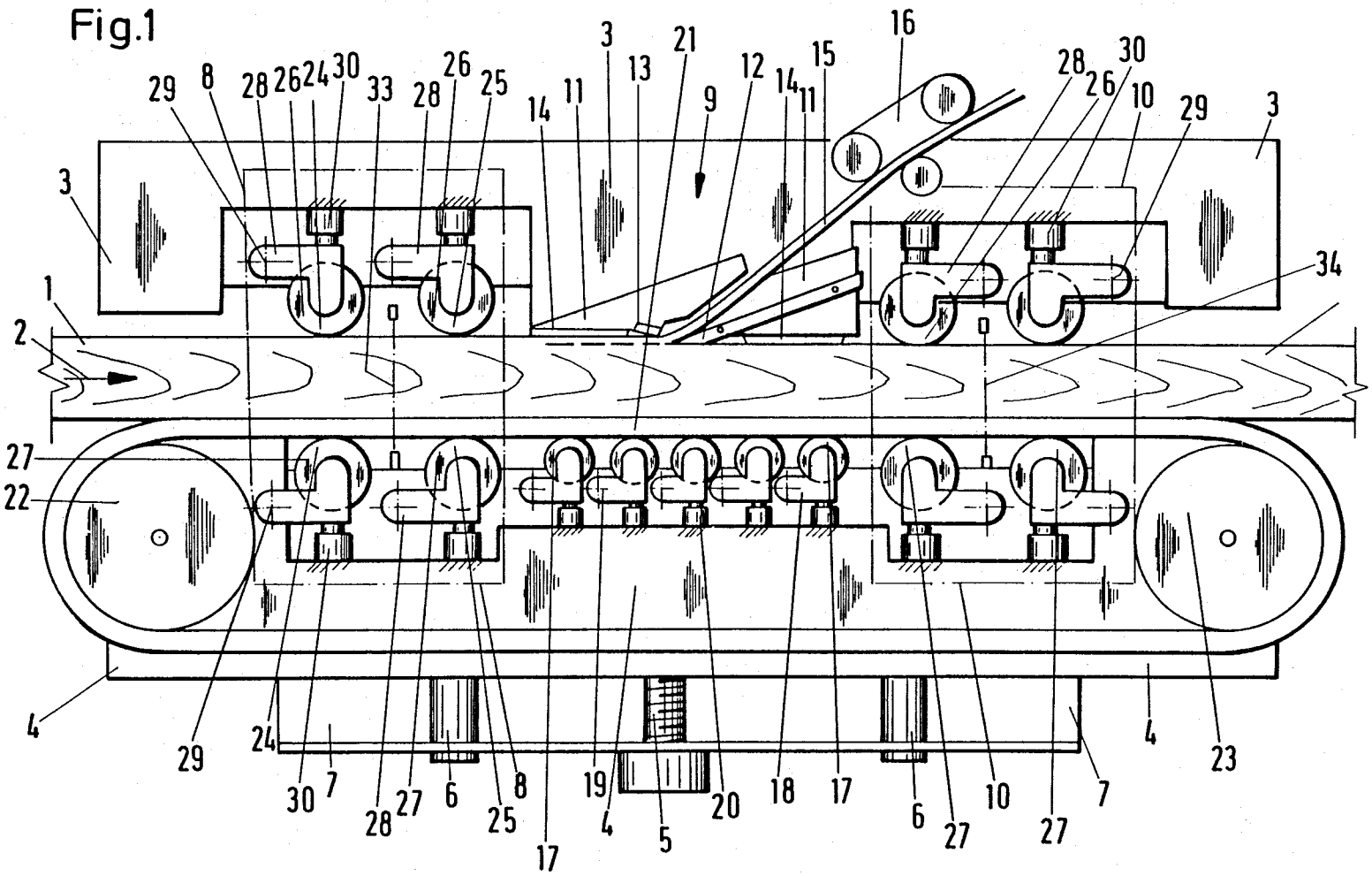
FIG. 1 is a plan view of an apparatus for producing thin boards, the apparatus having a single blade for separating a board from one side of a log.

Referring to FIG. 1, a squared timber 1 which is being processed passes through an apparatus shown in plan view in FIG. 1, the timber moving in the direction indicated by the arrow 2 on a support track which is known in wood processing systems. This support track can be in the form of an elongated supporting surface that can, if necessary, be adjustable in height and on which the timber rests and slides along. Essentially, the apparatus that processes the squared timber 1 is arranged on both sides of the support track or of the squared timber that is being processed. It has a left-hand frame section 3 and a right hand frame section 4. The right-hand frame section 4 can be moved, for example, by means of a worm drive 5 on horizontal slide supports 6 transversely to the direction of the feed 2 of the squared timber 1. A support structure 7 for the slide supports 6 of the right-hand frame section 4 can be connected with the left-hand frame section 3 beneath the support track by means of a common machine base. The ability of the right-hand frame section 4 to move transversely simply ensures that the left-hand and the right-hand parts of the apparatus can be moved apart, and that the apparatus can be adjusted to accommodate squared timbers 1 of different widths. In order to process squared timbers of equal widths, the right-hand frame section 4 is adjusted to a fixed position and, for purposes of describing the manner in which the apparatus functions, can hereinafter be regarded as fixed, in the same manner as the left-hand frame section 3.

From the point of view of function, viewed in the direction 2 in which the wood is moved, the machine is divided into an infeed section 8 identified by a dashed line, a cutting station 9, and an outfeed section 10, the section being also surrounded by a dashed line in the drawing. Each of these three sections 8, 9 and 10 is subdivided into a section that is located on the left-hand section of the frame, and a section that is located on the right-hand section of the frame.

The cutter station 9 consists of a blade holder 11, a blade 12 secured thereto, a pressure rail 13 that is located ahead of the cutter blade, and guide surfaces 14 that are located on both sides of the blade arrangement. The drawing shows how a thin cut board 15 is severed from the squared timber 1 by the blade 12 and passed to a straightening system 16, although this does not form any part of the present invention.

A series of pressure rollers 17 is arranged on the frame section 4 opposite the blade arrangement installed on the frame section 3. Each of these pressure rollers is supported by a swinging arm 18 at a pivot point 19 within the right-hand frame section 4. A pressure cylinder 20 acts on each of the swinging arms 19, the other end of each cylinder being fixed to and supported on the right-hand frame section 4. All of the pressure rollers 17 lie within the confines of a circulating flexible, resilient belt 21 that passes over two guide rollers 22 and 23, the latter being supported so as to be able to pivot in the right-hand frame section 4. Once the pressure cylinders 20 have been acted on by pressurized fluid, the pressure rollers 17 press the squared timber 1 against the blade arrangement that is located on the opposite section 3 of the frame. The pressure rollers 17 can be actuated individually or collectively by the pressurized fluid.

It should be emphasized that the pressure rail 13 of the blade arrangement extends somewhat farther in the direction of the squared timber than does the guide surface 14. Pressing the squared timber against the guide surface 14 with the pressure rollers 17 means that the pressure rail 13 is pressed into the squared timber 1 that is moving past. This is necessary to avoid the wood splitting ahead of the blade 12 when the boards 15 are taken off by chipless separation. The pressure and the manner in which the squared timber is pressed against the blade arrangement are vital for the quality of the product that is obtained, for which reason the arrangement and the configuration of the pressure rollers as well as control of the application pressure, are all of particular importance.

In the embodiment shown, there is only a single blade 12. If necessary, however, a plurality of blades can be provided in a staggered, tandem arrangement. It is also possible to arrange the blades 12 in a separate holder in the left-hand frame section 3 in order to impart a swinging movement to the blades in a direction perpendicular to the plane of the drawing, which extends in the direction of the feed 2, during the cutting process.

Figure 3:
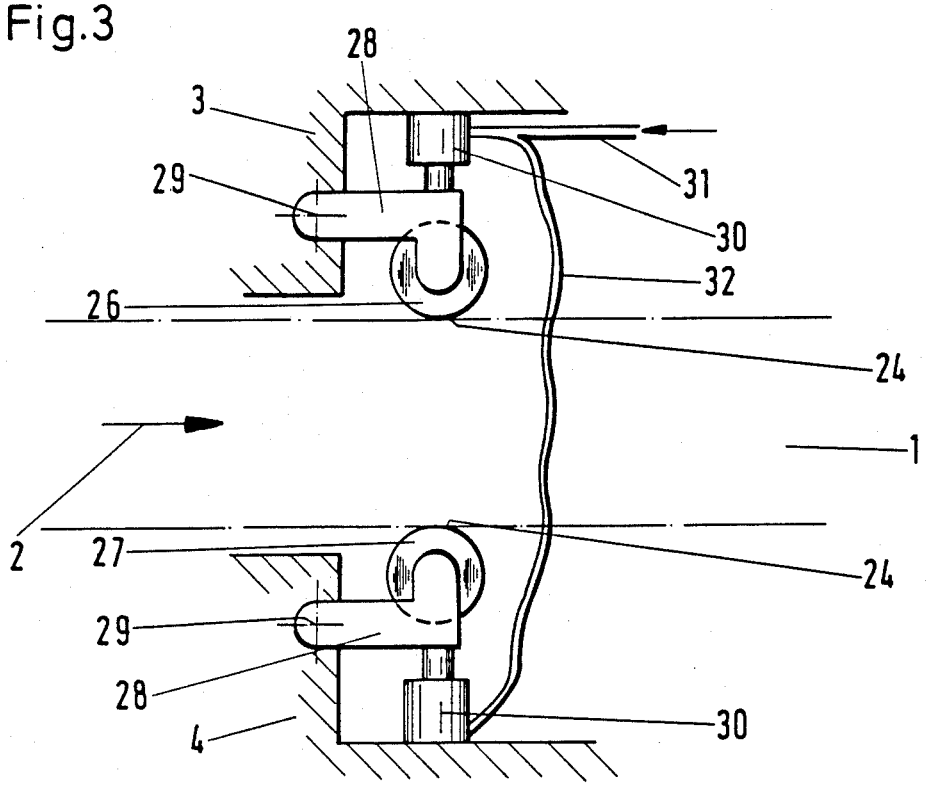
FIG. 3 is a somewhat schematic representation of a pair of feed rollers used in the apparatus shown in FIGS. 1 and 2.

The infeed system 8 is described below and this description also applies to the outfeed system 10 that is shown and which corresponds to the embodiments shown in FIG. 1. The infeed system 8 incorporates two pairs of feed rollers 24 and 25, each comprising a left-hand feed roller 26 and a right-hand feed roller 27. Each feed roller 26, 27 is supported by a swinging arm 28 so as to be able to pivot about a pivot point 29 in one of the frame sections 3 or 4, respectively, by means of the swinging arm 28. An operating cylinder 30 is connected to each swinging arm 28 and this is supported in the frame sections 3, or 4. The pressure roller pair 24 is also shown separately in FIG. 3. The operating cylinders 30 for the feed rollers 26, 27 can be acted upon by a pressurized fluid through a line 31. Their cylinder chambers are, however, additionally interconnected to each other by a pressure conduit 32 so that equal pressure is effective in both cylinders 30 of the pressure roller pair 24. The remaining pairs of pressure rollers of the infeed system 8 and the outfeed system 10 are acted upon in the same way. Such cross-connection of the pressure chambers of the operating cylinders of a pair of feed rollers ensures that while equal application pressure is maintained on both sides of the squared timber 1, the timber 1 will nevertheless be free to move transversely to a specific extent, in order to be able to follow unrestrictedly the working positions set by the cutter station 9, in both the entrance and the outfeed system. This is of great importance for proper functioning of the cutter system and for achieving good quality in the product. Since large forces are needed to feed the squared timber 1 toward the blade or blades 12, in general a greater application pressure must be applied to the feed rollers 26 and 27 than is needed at the contact pressure roller 17 in order to achieve optimal cutting results. For this reason, it is preferred that the pressure rollers 17 and the feed rollers 26 and 27 be controlled individually with regard to the amount of fluid pressure that is applied to them.

In the embodiments shown in FIG. 1, the resilient belt 21 also passes around the right hand feed roller 27. For this reason, in this embodiment the feed forces must also be transferred to the squared timber 1 through the belt 21. For design reasons this is a purely expedient measure, if the guide rollers 22 and 23 for the belt are arranged outside the feeder rollers 27, the rollers 27 can be positioned closer to the cutting station 9. However, it would also be possible to arrange the feed rollers 27 outside the belt 21. A drive system can be provided for the feed rollers 26 and 27. However, it is also possible the drive could be moved into the guide rollers 22 or 23, respectively, or that both systems could be provided with drives. The question does not arise in connection with the lefthand feed rollers 26 since there is no belt to transfer the force. However, it would also be possible to pass a rubber belt around the feed roller 26 on the left hand-side alone.

In the apparatus shown in FIG. 1, there is also a front sensor gate 33 and a rear sensor gate 34. These sensors are located in the vicinity of the infeed system or the outfeed system, respectively. These sensor gates are intended to signal the presence of a squared timber in the infeed system 8 or the outfeed system 10 so as to assist in appropriate control of the system.

It is also within the field of the present invention to not only connect the operating cylinders 20 of each pair of feed rollers 24 or 25 by means of a cross-connector line 32 but all of the feed rollers could be connected to each other by cross-connector lines in order to achieve an even application of pressure everywhere. All that is important is that the squared timber 1 is not forced by the feed rollers into a position that is at variance to that setup by the cutter station 9. However, it is expedient that the feed rollers of the infeed system 8 and those of the outfeed system 10 be controllable independently of each other. Basically, in the case of a continuous series of squared timbers, it is sufficient to have only one feed system. The provision of a second feed system in the form of the outfeed system is intended to make it possible to pull the end of a squared timber that is still being processed through the cutter station 9 while the infeed system has already picked up a new squared timber. When the end of a squared timber passes a sensor gate 33, 34 the associated feed system opens. If the beginning of a new squared timber enters the measuring gate, the associated feed system closes again.

Figure 2:
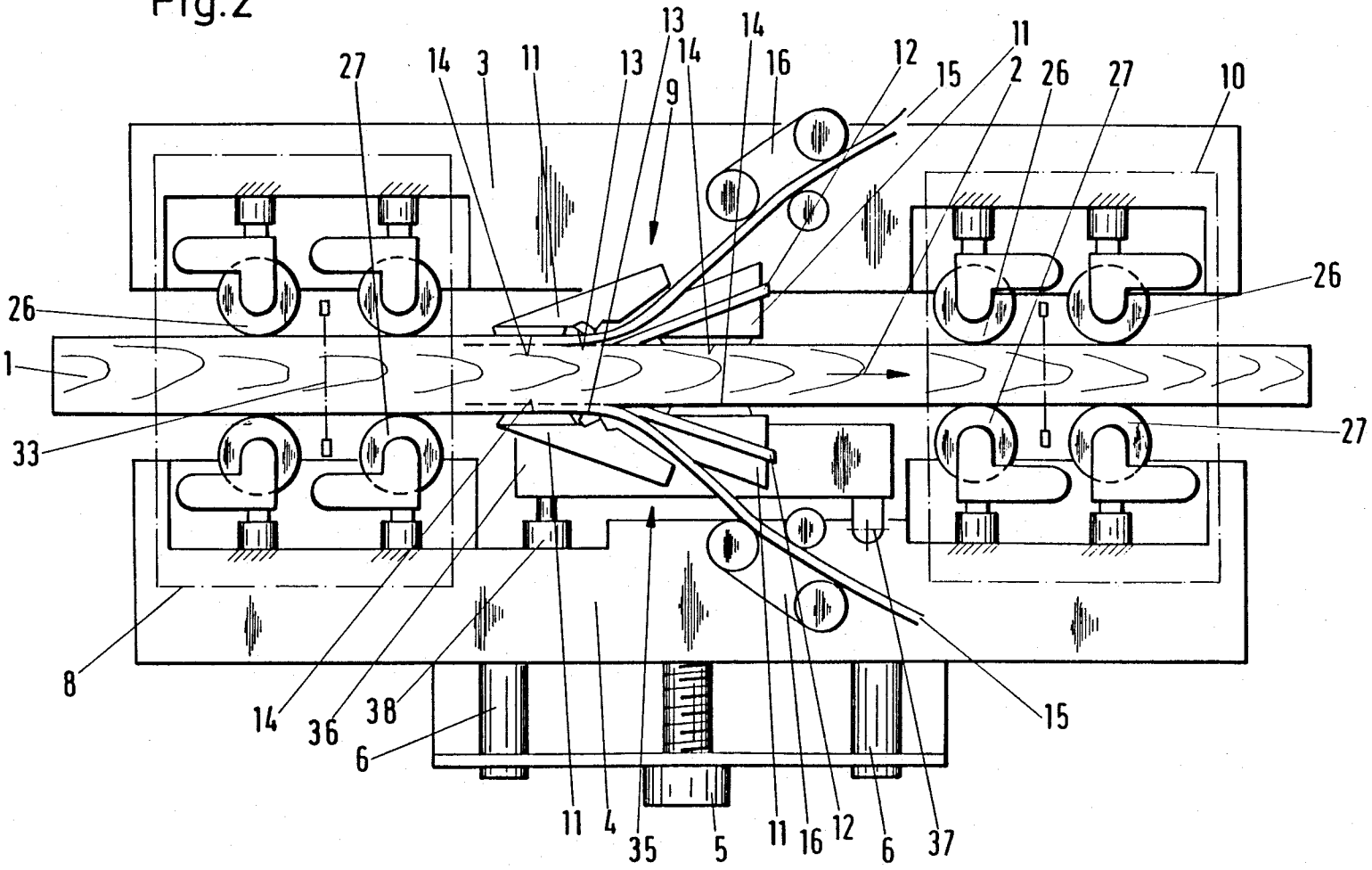
FIG. 2 is a plan view of another embodiment of the invention which employs two opposing single blades in order to separate a board from each of two opposite sides of the log.

FIG. 2 illustrates a modified form of the apparatus shown in FIG. 1. In this form of the invention, there are provided blades 12 which are opposed to each other in order to separate a thin board from each side of a squared timber 1. The left-hand cutter system which is uppermost in the drawing is exactly the same as that shown in FIG. 1. The right-hand cutter system 35 differs from the one on the left in that it is arranged within the right-hand frame section 4 on an independent support 36. The support is hinged at one end 37 onto the right-hand frame section 4 and at the other end is supported on the right-hand frame section 4 by means of a pressure cylinder 38. The pressure with which the two cutter stations 9 and 35 are pressed against the squared timber 1 can be adjusted by controlling the pressurized fluid acting on the pressure cylinder 38. The cutter station 35 is adjustable under pressure and replaces the pressure rollers 17 in the form of the invention shown in FIG. 1. Since in the form shown in FIG. 2 there are two cutter stations, the rubber belt that passes around the pressure rollers in FIG. 1 is also eliminated. For this reason, all of the feed rollers 26, 27 lie directly against the squared timber 1. In this embodiment, also, the operating cylinders for the pairs of opposing feed rollers are connected to each other by a cross-connector conduit.

Figure 4:
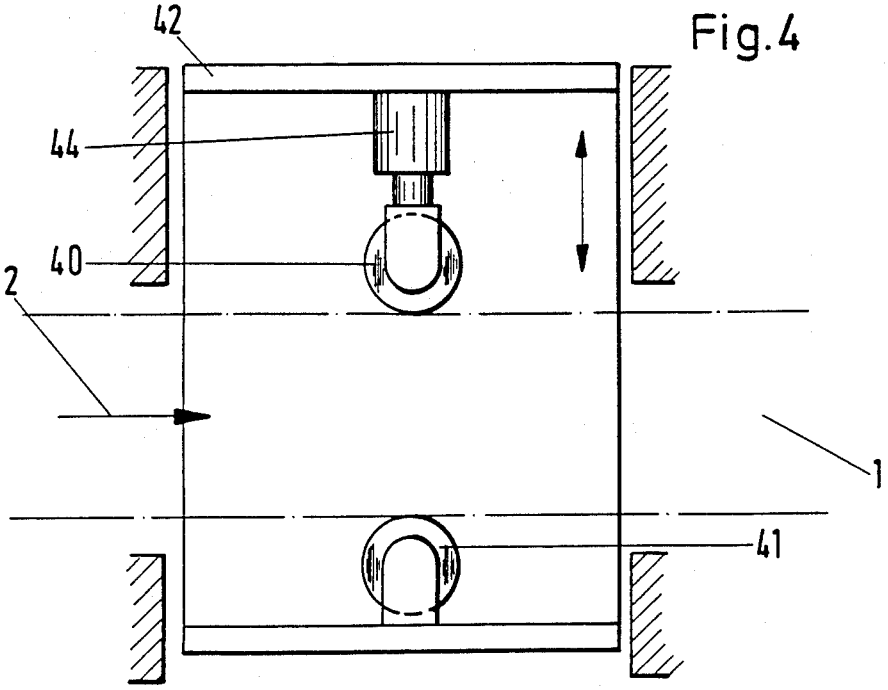
FIG. 4 is another arrangement of a pair of feed rollers arranged on a common movable slide.

FIG. 4 illustrates another embodiment for the freely movable arrangement of a pair of feed rollers. The rollers 40 and 41 are located on the slide 42 that can move freely back and forth within guides 43 in a direction transverse to the feed direction 2. Since the slide 42 can move transversely, all that is required in this embodiment is to provide one feed roller of a pair of feed rollers—in the examples shown, the feed roller 40—with an operating cylinder 44 which is supported on the slide 42 itself. This embodiment has the disadvantage that it is more costly than the arrangements shown in FIGS. 1 to 3 from the standpoint of design. It also has the disadvantage that with a limited working travel of the operating cylinder 44 the machine cannot be moved apart as a whole, as is possible by providing the movable frame section 4 in the embodiments shown in FIGS. 1 to 3. The cross-connector conduit 32 between the working cylinders 30 of the opposing feed rollers can be installed with sufficient reserve length to permit the two side sections of the machine to be moved apart as a whole.

It will be evident that various modifications can be made to the described embodiments without departing from the scope of the present invention.

I claim:

1. An apparatus for cutting thin board by chipless cutting from a squared timber on at least one side thereof comprising:

support means for supporting said square timber, a cutter station on at least one side of said squared timber and including a cutter blade engageable with said square timber, pressure applying means on the side of said squared timber opposite from said cutter station to urge said squared timber against said cutter station at an adjustable pressure, and a feed system arranged to move said squared timber toward said cutter blade, said feed system including at least one pair of opposite feed rollers, the rollers in said pair of opposite feed rollers being respectively located on opposite sides of said timber, means for freely moving each pair of opposite feed rollers as a discrete pair in a transverse direction relative to the feed direction for adapting the position of said opposite feed rollers to the position of said squared timber while maintaining symmetrical clamping forces.

2. An apparatus according to claim 1, wherein said pressure applying means includes another cutter station adjustably engageable with said squared timber.

3. An apparatus according to claim 1 which includes a slide on which said feed rollers are mounted, said slide being movable transversely to the direction of feed of said squared timber.

4. An apparatus according to claim 1, wherein said pressure applying means includes a plurality of fluid pressurized cylinders, and conduit means interconnecting said cylinders.

5. An apparatus according to claim 1, wherein a pair of said feed rollers is positioned ahead of and another pair of feed rollers is positioned behind said cutter station.

6. An apparatus according to claim 5, wherein at least two pairs of feed rollers are provided ahead of and behind said cutter station.

7. An apparatus according to claim 1, wherein said pressure applying means includes a plurality of individual pressure rollers and a moving resilient belt between said pressure rollers and said squared timber for transferring the roller pressure to said squared timber.

8. An apparatus according to claim 7, wherein said belt also passes over a pair of said feed rollers.

9. An apparatus according to claim 1 which includes means for adjusting the pressure applied by said pressure applying means independently of the clamping force provided by the pairs of feed rollers.

10. An apparatus according to claim 5 which includes means for moving apart and adjusting the pairs of rollers ahead of and behind said cutter station independently of each other.

* * * * *